US006091373A

United States Patent [19]

Raguenet

[11] Patent Number: 6,091,373

[45] Date of Patent: Jul. 18, 2000

[54] FEED DEVICE FOR A RADIATING ELEMENT OPERATING IN DUAL POLARIZATION

[75] Inventor: Gérard Raguenet, Eaunes, France

[73] Assignee: Alcatel Espace, Courbevoie, France

[21] Appl. No.: 08/044,113

[22] Filed: Apr. 8, 1993

Related U.S. Application Data

[63] Continuation of application No. 07/779,240, Oct. 19, 1991, abandoned.

[30] Foreign Application Priority Data

Oct. 18, 1990 [FR] France ..... 90 12896

[51] Int. Cl.[7] ..... H01Q 13/08; H01P 5/107

[52] U.S. Cl. ..... 343/778; 343/700 MS; 333/21 A; 333/137

[58] Field of Search ..... 343/700 MS, 789, 343/778, 786, 756, 769; 333/22 R, 136, 137, 128, 21 A, 125; H01Q 13/08, 1/38

[56] References Cited

U.S. PATENT DOCUMENTS

| | | | |
|---|---|---|---|
| 3,974,462 | 8/1976 | Fassett | 333/22 R |
| 4,208,660 | 6/1980 | McOwen, Jr. | 343/769 |
| 4,527,165 | 7/1985 | de Ronde | 343/778 |
| 4,596,047 | 6/1986 | Watanabe et al. | 343/840 |
| 4,614,947 | 9/1986 | Rammos | 343/778 |
| 4,829,314 | 5/1989 | Barbier et al. | 343/778 |
| 5,001,444 | 3/1991 | Salvan et al. | 343/786 |

FOREIGN PATENT DOCUMENTS

| | | |
|---|---|---|
| 0123350 | 4/1984 | European Pat. Off. . |
| 2603744 | 11/1988 | France . |

*Primary Examiner*—Michael C. Wimer

*Attorney, Agent, or Firm*—Sughrue, Mion, Zinn, Macpeak & Seas, PLLC

[57] ABSTRACT

A feed device for a radiating element operating in dual polarization, for use especially in the field of space transmission, comprises a first feed line penetrating into a first cavity located beneath said radiating element, and a second feed line disposed in a configuration orthogonal to the first line and penetrating into a second cavity located in line with the first, a conductive part forming a coupling slot between the two cavities.

9 Claims, 5 Drawing Sheets

FEED DEVICE FOR A RADIATING ELEMENT OPERATING IN DUAL POLARIZATION

This is a Continuation of application No. 07/779,240 filed Oct. 19, 1991, abandoned.

This invention relates to a feed device for a radiating element operating in dual polarization, which element may be of the waveguide type or of the printed circuit antenna type.

BACKGROUND OF THE INVENTION

The use of such printed circuit antennas (patch antennas, dipoles, ring slots, etc.) is increasing in the field of telecommunications.

Depending on the use envisioned (fixed site telecommunications, maritime or aeronautical telecommunications, broadcasting, position finding, relaying, etc.) the selection both of the type of radiating element and of the type of transmission line leads to a compromise involving a significant number of parameters:

suitability for use at radio frequency (RF);

degree of resolution of the technology;

type of interfaces required, connections;

power rating;

cost;

dimensions and mass; etc.

By integrating all these parameters and developing active antennas it is possible to offer printed circuit antennas as highly attractive and economical solutions for the majority of applications envisioned these days.

This is common practice for applications operating in the L band (1.5–1.6 GHz), in the S band (2 GHz), and in the C band (4–6 GHz), and it is tending to become more and more the case for applications in the K band, at present in the KU band (12.4–18 GHz). However the increase in frequency can only be achieved at the cost of great technological effort on account of the resulting difficult problems:

very severe increase in losses;

miniaturization of the radiating elements;

difficulties in connection and implementation.

Many applications require only a single polarization per frequency (linear or circular). In this case crossed polarization specifications are not in general very difficult to adhere to. This is the case with L band usage (aeronautical and maritime), S band (relays), L and S band (position finding). For this kind of application, different kinds of feed can be envisioned, depending on the radiating element involved.

The most commonly used excitation mode for printed circuit antennas are:

feed from a coaxial line;

feed in the plane of a microstrip transmission line;

feed by electromagnetic coupling from a microstrip or stripline transmission line.

The first two approaches have been extensively described and studied in so far as they are both easy to implement a priori and they exhibit similarity of propagation behavior with the radiating element itself, which may be approximated by a microstrip transmission line.

Solutions belonging to the third category mark a step forward in feed technology by de-coupling the radiating element from the main transmission line. The increase in the number of parameters thus makes it possible to obtain better control over the passband performance of the assembly.

A printed circuit antenna can thus be fed with the aid of an orthogonal coaxial line. The basic configuration consists in connecting the central conductor of the coaxial cable to a point under the patch where the impedance corresponds to the impedance of the coaxial cable. In fact, this technique is often insufficient in broad-band applications ($\geqq 1\%$) because of the probe effect which is due to the non-zero diameter of the conductor. In order to increase the performance of such a transition, devices have recently been developed to compensate he self-inductance of the probe, namely:

feed-in through a capacitive skirt implemented with the aid of an outer coaxial conductor sheath;

feed-in through a capacitive pellet on or under the patch.

These devices are widely known and described, for example in an article "Conformal microstrip antennas", Robert E. Munson (Microwave Journal, March 1988), which describes several types of microstrip antenna, their applications and their performance.

A printed circuit antenna (patch or dipole) can also be fed by means of a microstrip transmission line. Again, these types of feed are widely known. This feed mode is widely used and does not require any special procedures other than those of printing the patch itself. It is thus possible to feed the radiating elements and to implement the distribution elements in the same surface.

Finally, a printed circuit antenna can be fed by an electromagnetic coupling technique. This feed mode allows RF energy to be transferred from a main transmission line without any contact or mechanical connection between the conductors. Moreover by introducing parameters it makes it possible to obtain better control over the matching capacitances of the antenna. It is possible to feed a dipole or a patch type antenna from microstrip transmission lines. It is also possible to feed a radiating element from a stripline transmission line. This can offer features of interest compared with the electrical conditions of a microstrip, which is an open transmission line.

However, all these widely known implementations become difficult to put into effect for applications requiring the use of dual polarization. In fact, for this kind of application the problems become worse. Very often the basic radiating element is not alone but forms a sub-array and the overall problem consists in:

feeding the radiating elements with two orthogonal polarizations; and integrating the beam forming network (BFN) circuits within the physical mesh size of the array in such a manner as to realize a module which allows the objectives of polarization purity, passband, efficiency, radiation quality, etc. to be met with acceptable cost and technology.

Solutions of the type using two orthogonal coaxial probes lead to complex architectures for feeding the radiating element and for access to each of the BFN circuits. Regardless of the configuration, at least one single stage coaxial/stripline transition is needed as well as a two-stage transition, which involves increased complexity of technology relative to single polarization, associated moreover with poor intrinsic performance. The coupling between two coaxial probes is typically 20 dB for this type of excitation, thus involving re-radiation problems with crossed polarization to be resolved by subterfuges of introducing special sub-arrays (sequential rotations for example).

In any event, development is not easy because of parasitic phenomena. Moreover the solution requires a large amount of engineering and technological effort.

The object of the invention is to deal with the problem thus defined.

SUMMARY OF THE INVENTION

To this end the invention provides a novel feed device for a radiating element operating in dual polarization, wherein the device comprises a first feed line penetrating into a first cavity located beneath said radiating element, and a second feed line disposed in a configuration orthogonal to the first line and penetrating into a second cavity located in line with the first cavity, and a conductive part forming a coupling slot between the two cavities.

This device advantageously makes it possible to provide simultaneously, in a single unit, and without the need for mechanical contact (connectors):

- a radiating element that is fed with two orthogonal polarizations; and
- a structure in which each polarization is output at a separate level, thus allowing independent control of the BFN circuits and also complete integration of the distribution assembly under the array of radiating elements, without any need for connecting elements other than those existing between each feed device and its corresponding radiating element.

Moreover the device of the invention allows the distributor architecture and the implementation technology to be simplified considerably and the cost of the sub-arrays of radiating elements to be reduced.

BRIEF DESCRIPTION OF THE DRAWINGS

An embodiment of the invention is described by way of example with reference to the accompanying drawings, in which.

DETAILED DESCRIPTION

Figure 1:
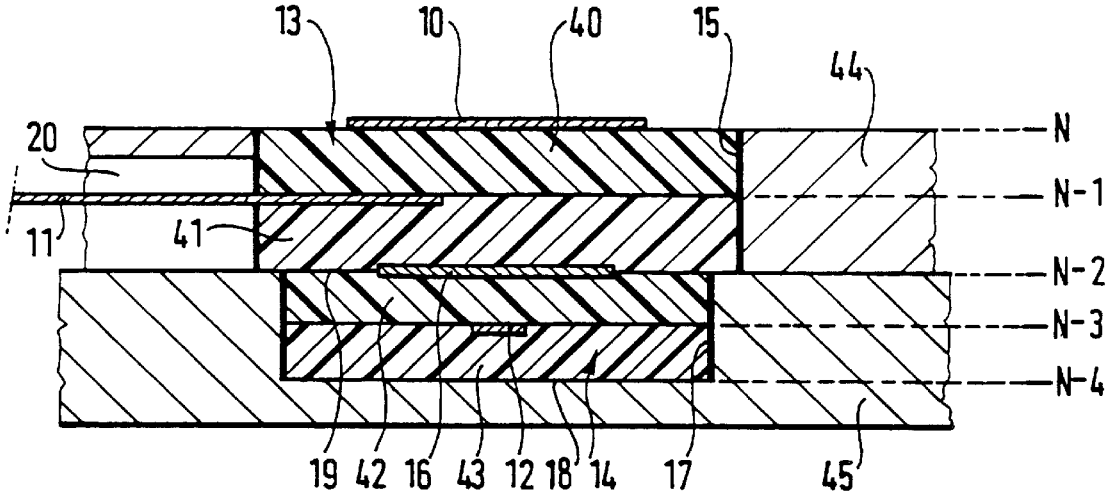
FIGS. 1 and 2 show a device forming one embodiment of the invention respectively in section and in plan view.
Figure 2:
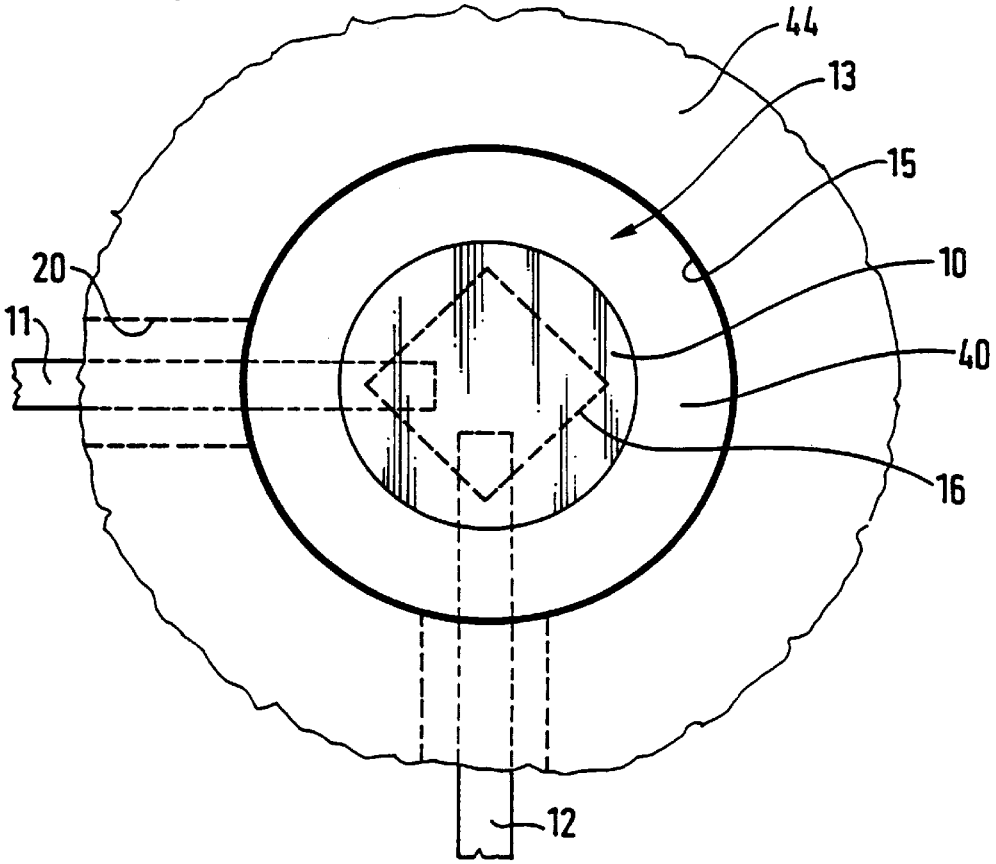

The radiating element 10 shown in FIG. 1 forming a first embodiment of the invention, of the patch type, may be of composite technology or otherwise, and it is excited by use of a multi-slot, multi-cavity structure. Such a structure makes it possible to achieve in a single operation:

- feeding a radiating element with two orthogonal modes with high decoupling between ports (≧30 dB);
- changes of plane necessary for embedding beam forming circuits for each of the polarizations.

Typically, two feed lines 11 and 12 corresponding to the terminations of two beam formers are embedded at different levels under a radiating element 10.

The first line 11, as either microstrip or stripline, symmetrical or not, penetrates into a first cylindrical cavity 13. This "open" cavity is formed by the assembly of a conductive cylinder 15, for example made of metal, of diameter øa, and two metal patches, namely patch 10 at level N and patch 16 at level N-2, which thus constitute "covers" for the said cylinder. In accordance with rules known to the person skilled in the art, the entrance slot 20 of the line 11 to the first cylindrical cavity 13 is dimensioned to match the field distribution along the line 11.

In the same way, the second line 12 of the second distributor, disposed geometrically orthogonal to the first line 11, penetrates into a second cylindrical cavity 14 of diameter øb located at a level N-3 lower than that of the first cavity 13 and concentric therewith. This second cavity 14 is formed by an assembly comprising a cylindrical electrically conductive wall 17, a metallized base 18 and the metal patch 16 which also forms the base of the first cavity 13.

The two cavities 13 and 14 are thus embedded one above the other and have the patch 16 in common which has a major role in the operation of the two-stage device, as is described below. In the example shown, they contain dielectric spacers 40, 41 and 42, 43 enabling the two lines 11 and 12 to be positioned, the spacers being arranged in two blocks 44 and 45, e.g. made of brass.

An electromagnetic wave is conveyed by the first line 11 into the interior of the first cavity 13. This cavity assembly acts as a matched directional three-port network. This requires:

- firstly, the geometry of the conductors present to be optimized such as to match the impedance of the radiating element 10 to each feed line; and
- secondly, great care in the geometry of the element 16 and consequently in the nature of the coupling slot 19. This patch 16 to some extent plays the role of a polarization isolator, which acts like a short-circuit for the wave conveyed by the first line 11, thus providing a closed condition relative to the lower stages. Typically the geometry of the conductive patch 16 and of the slot 19 may alternatively take the form of one or more rectangular slots extending parallel to the conductor 11.

Thus the cavity 13 acts as a directional coupler relative to the lower stages such that no transfer of energy takes place from the first line 11 towards the second line 12, which exhibits a high degree of coupling for this reason. The energy conveyed by the first line 11 is thus transferred completely to the radiating element 10, without coupling into the line 12.

The second line 12, which is at the level N-3 has a configuration of field lines compatible with the slot 19 or plural slots, corresponding thereto. For this reason, RF energy contained in the second cavity 14 can couple into the first cavity 13. At this level the sole matched output presented by the assembly is the radiating element 10, such that any energy initially conveyed by the line 12 cannot couple into the line 11, on account of the orthogonality imposed on the lines of force relative to the line 11. The excitation of the radiating element 10 with the polarization of the second line 12 thus uses both of the cavities 13 and 14 together with a coupling patch device 16 and coupling slot 19 which is polarization selective. Matching the radiating element 10 to the line 12 thus brings into action the characteristics of all the conductors and their respective geometries.

Figure 3:
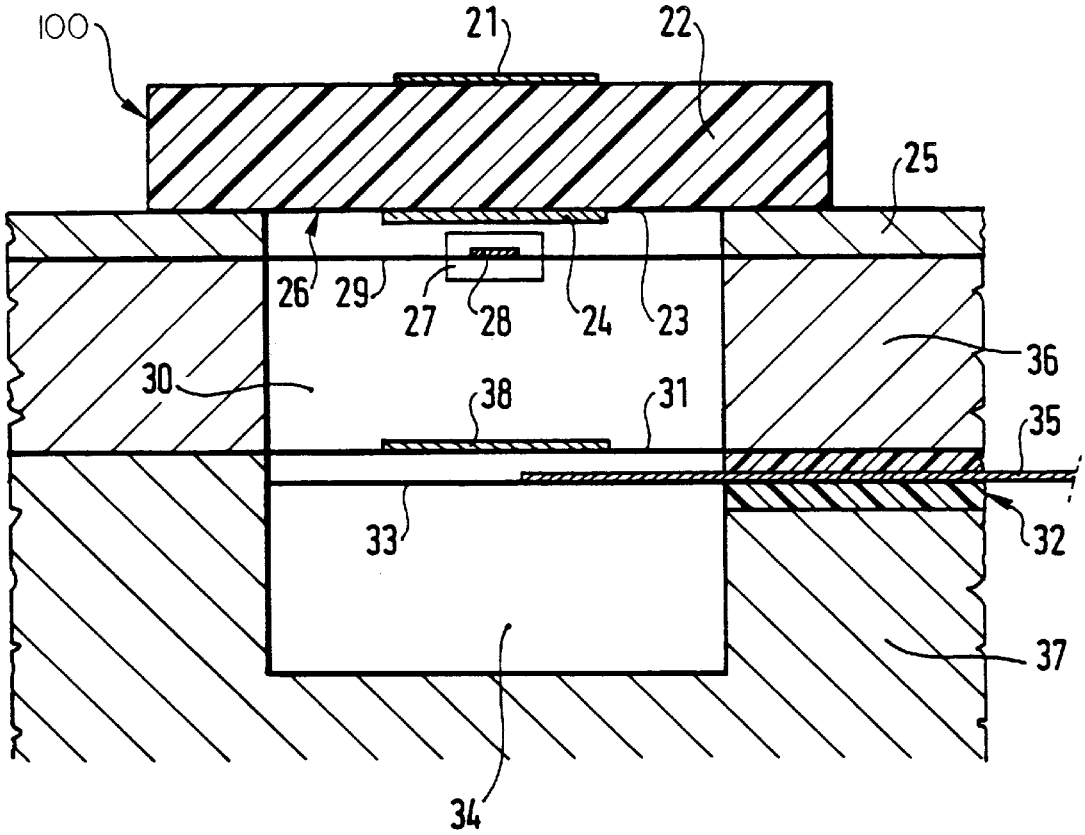
FIGS. 3 to 6 show respectively an implementation of a device forming a second embodiment of the invention and several operating curves.

In a variant implementation. FIG. 3, at 100 the cavity 14 has a more elaborate form, involving a third cavity of diameter øc, embedded under the first two cavities and in line therewith, with øc≦øb≦øa. This is intended to increase the number of parameters available for matching the assembly to the line 12. Thus, a succession of n superimposed cavities can be used so as to isolate the optimization parameters.

FIG. 3 shows the geometry of a radiating element having two orthogonal polarizations, implemented in the KU band, and corresponding to the principles described above.

Figure 4:
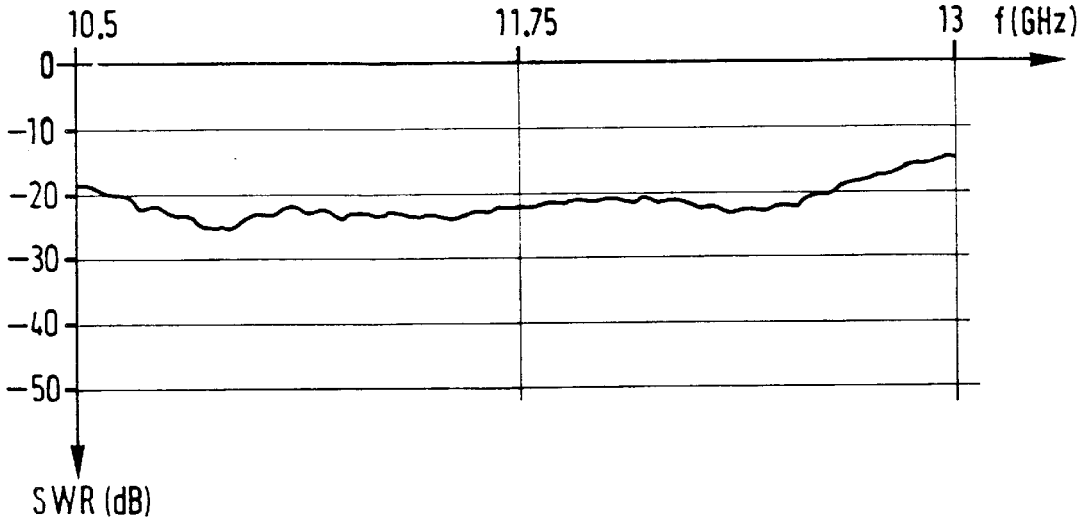
Figure 5:
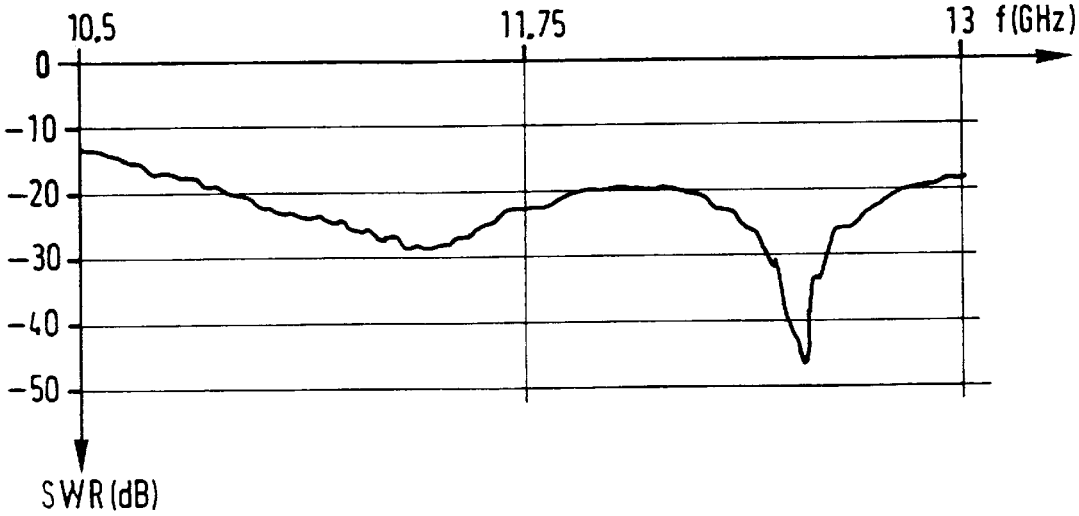
Figure 6:
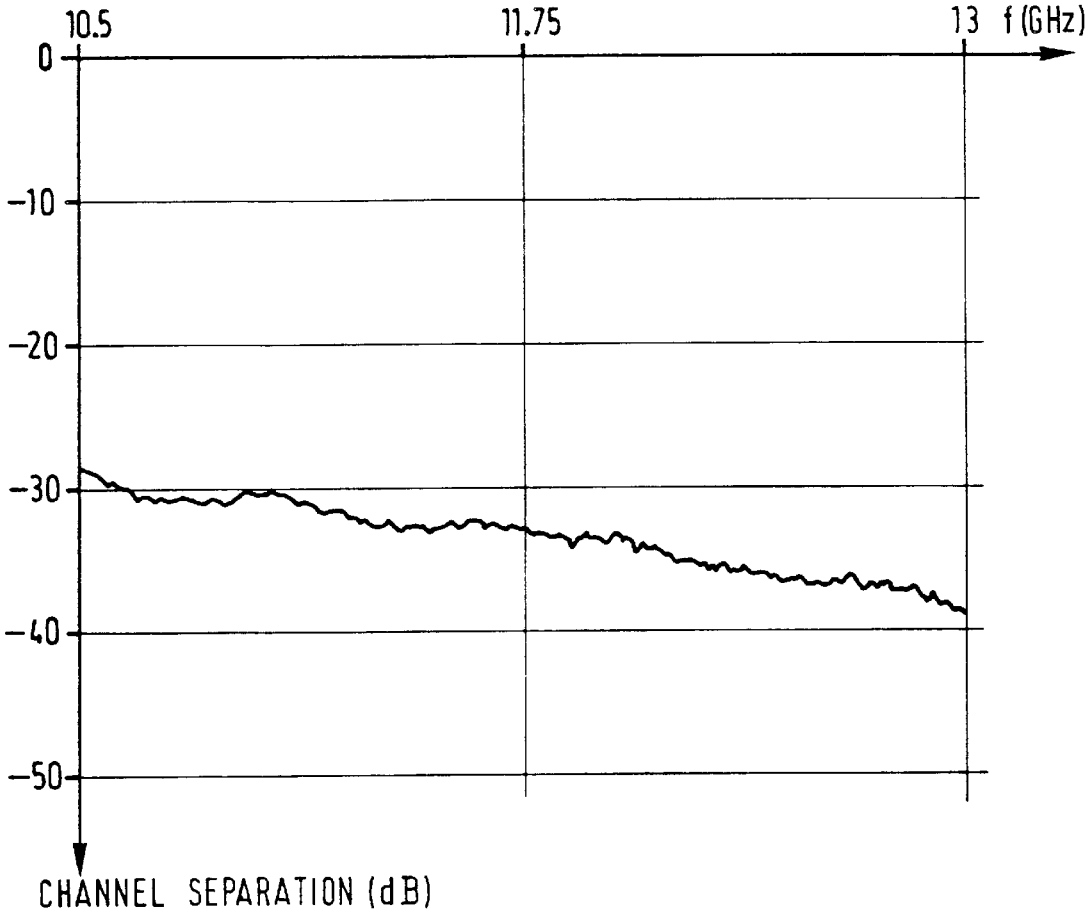

Typical performance of such a device is given in FIGS. 4 to 6.

This device has the following features. A two-stage radiating element 100 comprises: a square copper patch 21 of side 6 mm and a thickness 0.2 mm, and which is active for the upper port; a 4.2 mm high layer 22 of honeycomb; a layer 23 of Kapton adhesive tape; a circular patch 24 of brass stuck on the lower surface of the Kapton adhesive tape, with diameter 6.8 mm and thickness 0.3 mm; a 0.4 mm thick brass plate or patch 25, a 14 mm wide slot 26; a 0.8 mm thick stripline 27; a 100 ohm line 28 that is about 0.01 mm thick and has a projecting length of 5 mm; a quartz-filled polyamide film 29, that is about 0.1 mm thick; a first cavity 30 of diameter 14 mm and height 5.8 mm, formed in a first block of brass 36; a quartz-filled polyamide film 31 that is about 0.1 mm thick, and on which there is located a patch 38 of brass of diameter 7 mm and thickness 0.3 mm, forming a short-circuit for the upper polarization direction; a 0.8 mm thick stripline 32; a 100 ohm line 35 that is about 0.01 mm thick and has a projecting length of 5 mm; a sheet of polyamide film 33 that is about 0.1 mm thick; and a second cavity 34 of diameter 14 mm and height 5.8 mm, formed in a second block of brass 37.

FIGS. 4 and 5 are graphs of polarization matching as a function of frequency, relating respectively to:

upper port SWR (FIG. 4): −20 dB from 10.50 GHz to 12.75 GHz, that is to say about 20% of the pass band at SWR=1.22.

lower port SWR (FIG. 5): similar performance covering 20% of the pass band at SWR=1.22.

FIG. 6 is a graph of the channel separation between ports as a function of frequency. Over the entire band, the device exhibits channel separation between the upper and lower ports which is better than 30 dB, with a mean value about 33 dB.

On investigating the radiation patterns measured for each of the ports at the central frequency, it appears that excellent polarization purity is obtained as a result of the absence of coupling between the ports, the results being the same at all points as the results obtained when the same type of radiating element is operated with single polarization.

In one embodiment of a sub-array with 32 radiating elements, it is seen clearly that, for one level of the BFN, the feed of 1 by 4 sub-arrays is easily implemented beneath the array of radiating elements; moreover by feeding each of the polarizations separately in two distinct planes, it is possible to obtain a very high degree of integration in the distribution associated with each polarization. By way of example it is possible to realize a 1 by 32 circuit embedded as a whole at the same level without it being necessary to effect any change of plane other than that of the exciting device for each radiating element.

A similar distributor for the other polarization can be integrated in totally independent manner in its corresponding level.

Thus the proposed approach to a radiating element—with an integrated level-changing exciter—has very advantageous repercussions at sub-array level for which it simplifies considerably the distribution architecture and the implementing technology, and therefore reduces cost at industrial level.

Using in-plane technology, fundamental installation problems appear even for a sub-array of four elements, namely the near impossibility of fitting the BFN circuits within the mesh-size of the array, and the need to provide for changes of plane.

Figure 7:
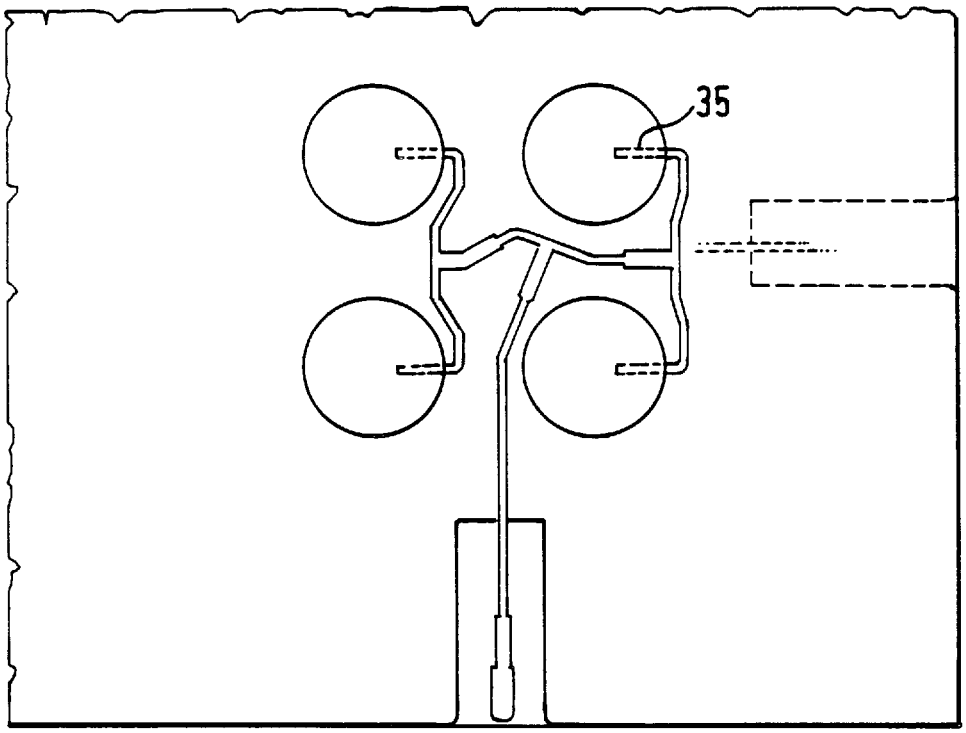
FIGS. 7 and 8 show an a device forming a third embodiment of the invention to a sub-array of four elements.
Figure 8:
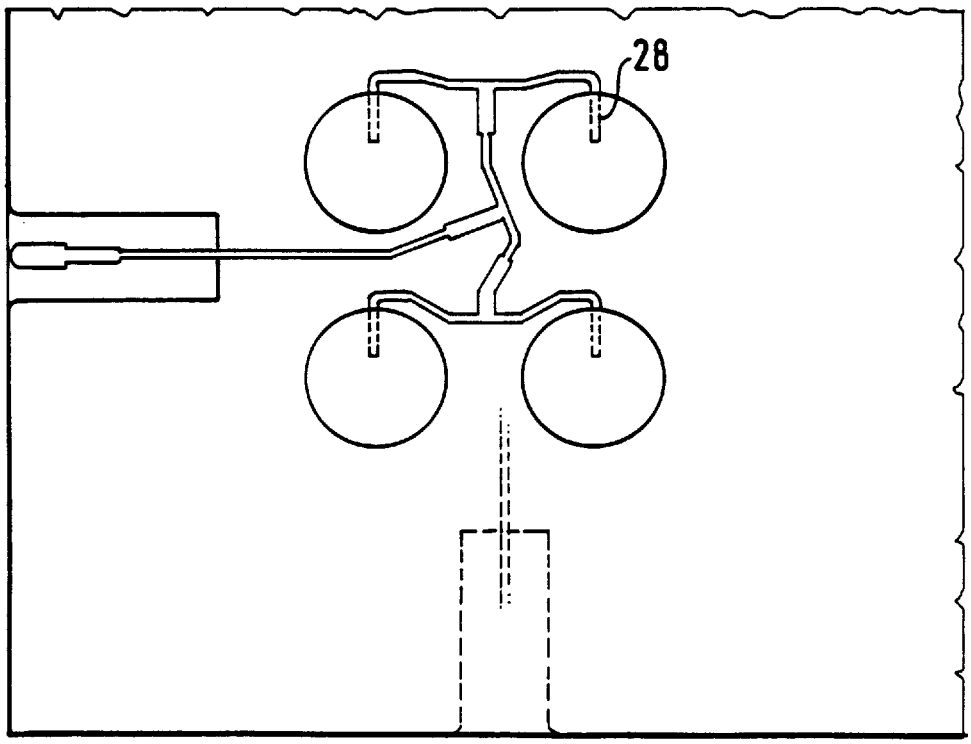

However, using the device of the invention, all these problems are resolved. Thus FIG. 7 shows the detail of the circuits and the cavities located under the radiating elements for a first distributor. FIG. 8 shows the detail of the circuits and the cavities for a second distributor embedded at a second level. The diagrams are the same, but the topology is rotated through 90°.

It is evident that the present invention has only been described and illustrated by way of preferred example and that its constituent parts can be replaced by equivalent parts without in any way departing from the scope of the invention.

Thus the radiating elements 10, 100 can excite a passive resonator so as to implement a wideband radiating element.

In like manner, whether it uses a passive resonator or not, the device described can serve to feed a microwave component such as a waveguide or a radiating horn (corrugated, dual mode, etc.) in a manner known to the person skilled in the art.

I claim:

1. A feed device for a radiating element operating in dual polarization, said feed device comprising: means defining a first cavity, means defining a second cavity, said first cavity comprising an interior electrically conductive cavity wall at least partially enclosing said first cavity, said second cavity comprising an interior electrically conductive cavity wall at least partially enclosing said second cavity, said feed device further comprising a coupling device for electromagnetically coupling said cavities, a first feed line and a second feed line for transporting respective electromagnetic waves to said radiating element; wherein said radiating element, said first cavity and said second cavity are respectively aligned along an imaginary principal axis defining a main direction of radiation of said radiating element; wherein said first feed line penetrates into said first cavity and is oriented perpendicular to said principal axis; and wherein said second feed line penetrates into said second cavity and is oriented perpendicular to said principal axis and orthogonal to said first feed line; and wherein said coupling device is a coupling slot defined by a conductive member placed between said first and said second cavities, sized smaller than said cavities, spaced from said conductive cavity walls, and partially closing off adjacent ends of said cavities.

2. A device according to claim 1, wherein said conductive member is positioned relative to said first feed line so as to effect a short circuit to an electromagnetic wave transported by said first feed line and constitutes a polarization isolator for electromagnetic waves transported by said second feed line.

3. A device according to claim 1, wherein said first and said second cavities are coaxial circularly cylindrical cavities, coincident with said imaginary principal axis, and wherein said second cavity has a diameter smaller than a diameter of said first cavity.

4. A device according to claim 3, wherein said first cavity is a conductive cylindrical cavity located between said radiating element and said conductive member, and said radiating element and said conductive member partially close off respective opposite ends of said first cavity.

5. A device according to claim 3, wherein said second cavity is a conductive cylindrical cavity, and said second cavity is enclosed on one end by a metallized element forming a base for said second cavity, and is partially enclosed on an opposite end by said conductive member.

6. A device according to claim 4, further comprising a third cavity, said third cavity being circularly cylindrical and coaxial with said first and second circularly cylindrical cavities, aligned after said first and said second cavities, and said third cavity having a diameter not exceeding either diameter of said first and second cavities.

7. A device according to claim 1, further comprising spacer means for positioning said first feed line in said first cavity and said second feed line in said second cavity.

8. A device according to claim 1, wherein said first and said second feed lines are microstrips.

9. A device according to claim 1, wherein said first and second feed lines are strip lines.

* * * * *